United States Patent [19]

Brago

[11] 4,113,182

[45] Sep. 12, 1978

[54] MULTI-FLUID WASH SYSTEM

[76] Inventor: Reacelyn A. Brago, 1964 E. Oak Rd., Apt. J-6, Vineland, N.J. 08375

[21] Appl. No.: 779,151

[22] Filed: Mar. 18, 1977

[51] Int. Cl.[2] ..... B05B 7/26

[52] U.S. Cl. ..... 239/304; 222/134; 222/145; 239/416.1; 239/417.5; 239/428

[58] Field of Search ..... 239/61, 304, 305, 335, 239/413, 416.1, 417.5, 428, 310, 303; 222/132, 145

[56] References Cited

U.S. PATENT DOCUMENTS

| | | | |
|---|---|---|---|
| 1,567,220 | 12/1925 | Williamson | 239/428 X |
| 2,587,722 | 3/1952 | Garratt et al. | 239/304 X |
| 3,322,350 | 5/1967 | Heinicke et al. | 239/304 X |
| 3,421,694 | 1/1969 | Müller | 239/304 X |
| 4,029,260 | 6/1977 | Herrick | 239/310 X |

FOREIGN PATENT DOCUMENTS

| | | | |
|---|---|---|---|
| 822,308 | 10/1959 | United Kingdom | 239/305 |

*Primary Examiner*—Bruce H. Stoner, Jr.
*Assistant Examiner*—Andres Kashinkow
*Attorney, Agent, or Firm*—Arthur A. Jacobs

[57] ABSTRACT

A spray gun system having a multiplicity of individual fluid sources that are connected to a mixing chamber by individual conduits, each conduit having a metering and shut-off valve therein, and the mixing chamber being connected to the spray nozzle.

5 Claims, 2 Drawing Figures

FIG. 1
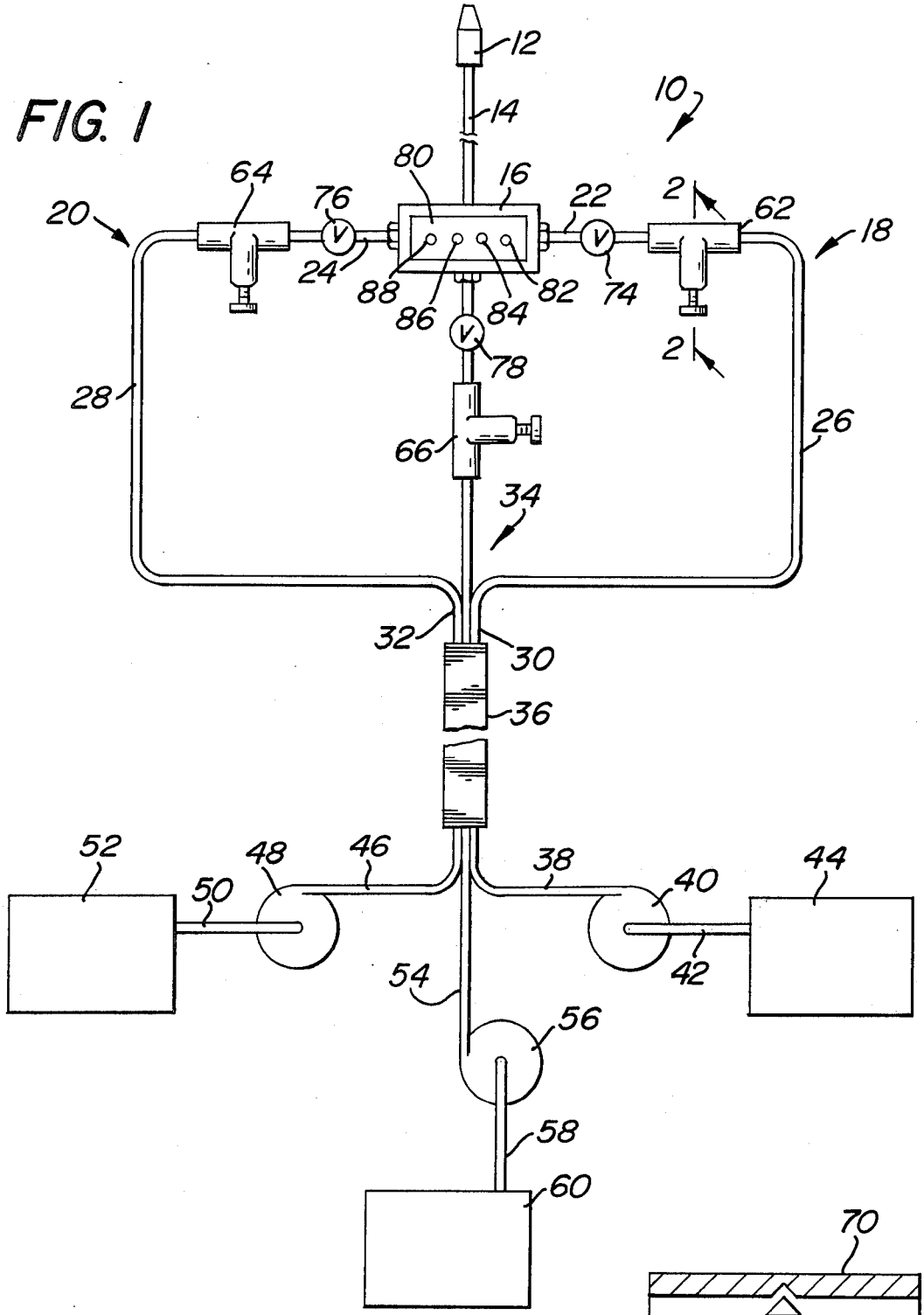
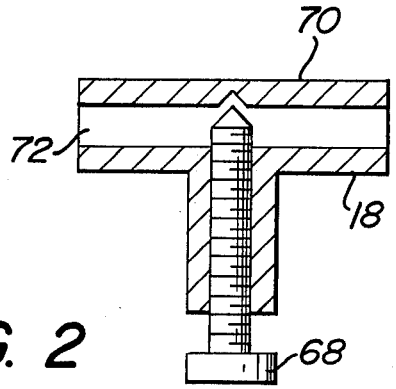
FIG. 2

MULTI-FLUID WASH SYSTEM

This invention relates to a spray gun assembly, and it particularly relates to a spray gun assembly wherein the spray gun is adapted to propel streams of different fluids either individually or in selected mixtures with each other.

Heretofore, spray guns generally used a single hose or conduit leading from one or more sources of fluids to the gun. If only one fluid was to be used after another fluid or mixture of fluids had been used, it was necessary to completely clear the conduit, as by thorough rinsing, in order to prevent contamination of the one fluid by the other. This not only was a waste of time and energy but a waste of fluids. In addition, these prior systems often were unduly complex and required relatively complicated electrical control systems.

It is one object of the present invention to overcome the defects of the prior art spray gun systems by providing a spray gun system wherein multiple sources of different fluids are selectively connected directly to the gun for individual or intermixed fluid sprays, without the interposition of a common conduit which would require clearing between utilizations of different fluids.

Another object of the present invention is to provide a spray gun system of the aforesaid type which is relatively simple in construction and operation and relatively inexpensive to manufacture.

Other objects and many of the attendant advantages of this invention will be readily appreciated as the same becomes better understood by reference to the following description when read in conjunction with the accompanying drawings wherein:

FIG. 1 is an elevational view of a spray gun assembly embodying the present invention.

FIG. 2 is a sectional view taken on line 2—2 of FIG. 1, showing the construction of the metering valve for adjusting the flow.

Referring in greater detail to the drawing, the spray gun assembly, generally designated 10, comprises a spray nozzle 12 mounted on a spray pipe 14 which extends from a mixing chamber 16. Extending into the chamber 16 from one end is a conduit 18, and extending into the opposite end of the chamber 16 is a conduit 20. These two conduits each include longitudinal inlet portions, as at 22 and 24, respectively, transverse mid-portions, as at 26 and 28, respectively, and lower portions, as at 30 and 32, respectively. Leading into the lower side of the chamber 16 is one end of a third conduit 34 which is in alignment with the spray pipe 14. All three conduits 18, 20 and 34 are tied together at their lower portions by a sleeve, or the like, shown at 36. The terms "longitudinal", "transverse" and "lower" are here used only in relation to the position of the assembly shown in the drawing but are not intended to limit the positioning of these parts in any direction desired.

The lower portions of the conduits are connected to respective individual high pressure pumps associated with respective individual fluid tanks. In this respect, the lower portion 30 of the conduit 18 is integral with an extension 38 leading to a pump 40 that is in fluid connection through a line 42 with a tank 44; the lower portion 32 of conduit 20 is integral with an extension 46 leading to a pump 48 that is in fluid connection through a line 50 with a tank 52; and the lower portion of conduit 34 is integral with an extension 54 leading to a pump 56 that is in fluid connection through a line 58 with a tank 60.

Although three separate conduits, pumps and tanks are illustrated, the number may vary in accordance with the number of different fluids which are desired to be used in the system. Furthermore, the shapes of the conduits 18, 20 and 34 are not limited to those shown but may be of any shapes that are desirable and feasible. In addition, the conduits that are illustrated are substantially rigid, but they may be of a greater or lesser degree of flexibility as desired.

Interposed in each of the conduits is a manually-operable metering valve assembly, shown, respectively, for each conduit at 62, 64 and 66. As shown in FIG. 2, the metering valve assembly 62 (which is identical to each of the others) comprises a needle valve 68 movable in a channel 70 transverse to the passage 72 in conduit 18. Movement of the valve 68 up and down adjusts the flow through the passage 72.

Interposed between each of the metering valves and the mixing chamber 16 is a check valve of standard construction, such as a ball valve or the like. These check valves are respectively designated 74, 76 and 78.

Mounted on the external wall of the chamber 16 is a control panel 80 which is provided with an "on-off" switch button 82 and switch buttons 84, 86 and 88, each of which is electrically connected to a respective pump 40, 48 or 56 to operate that pump. The switches, which are of standard type, move into the "on" position when once depressed and into the "off" position when again depressed. Any other feasible type of switch means may be used if desired, since the switch means, by itself, forms no part of the present invention.

In operation, each tank 44, 52 and 60 is filled with a different fluid such as a particular treating chemical. If it is desired to use a mixture of equal parts of all three treating fluids, the respective metering valves 62, 64 and 66 are fully opened and the pumps 40, 48, and 56 are operated to pump the three fluids directly into the mixing chamber 16. If only two of the fluids are desired in the mixture, the metering valve to the unwanted fluid tank is fully closed before operation of the pumps for the other two fluids. If only one fluid is desired, the metering valves for the other two are fully closed. If a certain proportion of one or more fluids relative to the others is desired in the mixture, the metering valve in the particular fluid line is adjusted to permit only such proportion to flow through. In this respect, each metering valve may be provided with a measurement indicator for various amounts of flow.

The check valves 74, 76 and 78 are constructed to permit flow only toward the mixing chamber while preventing back-flow.

With the metering valves in their desired setting, the switch button 82 is depressed to place the system in operative condition and then all or any one or more of the switch buttons 84, 86 and 88 are depressed to operate the respective pumps.

Although the three conduits shown are all connected to pumpable treating fluids, one of the conduits may be connected to a source of tap water, either with or without the interposition of a pump, or an additional water conduit may be connected to the mixing chamber. Furthermore, in addition to operating singly or in simultaneous admixture, the fluids may be operated alternatively, as when one fluid is a soap solution, another a solvent solution and the third a rinse water.

It is to be understood that an important aspect of this invention is the fact that none of the fluids utilize any common conduit. All utilize separate conduits so that any mixing that takes place does so only in the mixing chamber. In this manner, there is never any contamination of any conduit by one or more of the fluids whose use has been discontinued while another fluid is being utilized. The lack of any such contamination obviates any necessity for tedious and often inadequate rinsing of the conduit between utilizations for different fluids.

The invention claimed is:

1. A spray gun system comprising a spray nozzle in fluid connection with a mixing chamber, a plurality of conduits, each in direct fluid connection with said mixing chamber, a shut-off and metering valve means in each of said conduits, each of said conduits being in fluid connection with a separate corresponding source of fluid, each conduit having a separate corresponding pump operatively connected between it and its corresponding source of fluid, said conduits being separated from each other and interconnected only by said mixing chamber, and individual control means on said mixing chamber for individually passing fluids from each of said sources of fluid through the corresponding conduits into said mixing chamber, said spray nozzle being directly connected to said mixing chamber and extending therefrom.

2. The system of claim 1 wherein the fluids from said sources of fluid are under pressure.

3. The system of claim 1 wherein at least one of said sources of fluid is a source of water.

4. The system of claim 1 wherein said conduits are substantially rigid.

5. The system of claim 1 wherein said conduits are substantially flexible.

* * * * *